United States Patent [19]

LaBate

[11] Patent Number: 4,840,355

[45] Date of Patent: Jun. 20, 1989

[54] SLAG CONTROLLING DEVICE FOR BASIC OXYGEN FURNACES

[76] Inventor: Micheal D. LaBate, 116 Hazen Ave., Ellwood City, Pa. 16117

[21] Appl. No.: 218,305

[22] Filed: Jul. 13, 1988

[51] Int. Cl.[4] ..... B22D 41/08

[52] U.S. Cl. ..... 266/220; 222/603; 266/217

[58] Field of Search ..... 266/220, 270, 240, 236, 266/217; 222/603, 597

[56] References Cited

U.S. PATENT DOCUMENTS

| | | | |
|---|---|---|---|
| 4,360,190 | 11/1982 | Ato | 222/603 |
| 4,396,179 | 8/1983 | LaBate | 266/220 |
| 4,483,520 | 11/1984 | LaBate | 266/220 |
| 4,538,795 | 9/1985 | LaBate | 266/220 |
| 4,632,367 | 12/1986 | LaBate | 266/220 |
| 4,687,184 | 8/1987 | LaBate et al. | 266/270 |
| 4,725,047 | 2/1988 | LaBate | 266/270 |
| 4,767,036 | 8/1988 | Schleimer et al. | 222/603 |

*Primary Examiner*—S. Kastler

*Attorney, Agent, or Firm*—Harpman & Harpman

[57] ABSTRACT

Basic oxygen furnaces such as used in the production of steel comprise a vessel having a tap hole in an upper side wall section, the vessel being mounted for tilting motion with respect to its normal vertical position. Molten metal and slag thereon are separated in the area of the tap hole when the metal is being tapped by the introduction of gas such as argon or nitrogen through several slag controlling devices comprising refractory bodies defining a plurality of controlled passageways positioned around and about the tap hole.

6 Claims, 2 Drawing Sheets

SLAG CONTROLLING DEVICE FOR BASIC OXYGEN FURNACES

BACKGROUND OF THE INVENTION

1. Technical Field:

This invention relates to devices for directing gas into a mass of molten metal around the tap hole in a metallurgical vessel so as to cause an upward swirling and bubbling rising column of molten metal acting to move slag thereon away from the tap hole so that only clean metal is tapped from the vessel.

2. Description of the Prior Art:

Devices have been heretofore used for insufflating gas into a mass of molten metal for stirring the metal and/or introducing desirable agents and/or addivites into the molten metal. Such devices have incorporated porous plugs and impervious plugs with spaced sleeves thereabout adapted to provide passageways for gas therethrough. The latter devices may be seen in U.S. Pat. Nos. 4,396,179 to LaBate, 4,483,520 to LaBate, 4,538,795 to Labate, 4,632,367 to LaBate, 4,687,184 to LaBate, et al., and 4,725,047 to LaBate.

No devices are known that are capable of or being used to surround a tap hole in a metallurgical vessel for creating an upward bubbling swirling current of molten metal capable of moving slag on the molten metal away from the tap hole area so that only clean metal is tapped from the vessel.

SUMMARY OF THE INVENTION

The combination of a metallurgical vessel such as a basic oxygen furnace having a tap hole therein and one or more refractory devices defining a plurality of passageways around the tap hole through which gas in controlled and desirably shaped streams is directed into the molten metal so as to cause upwardly moving currents of the molten metal sufficient to move slag on the molten metal away from the area of the tap hole sufficiently to move slag on the molten away from the tap hole.

DESCRIPTION OF THE PREFERRED EMBODIMENT

Figure 1:
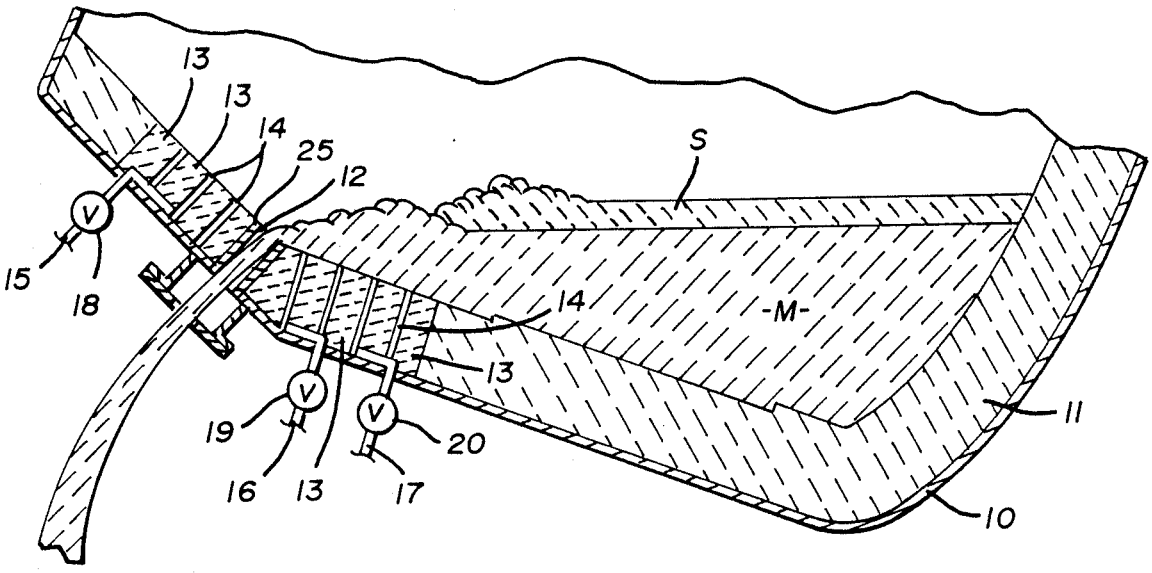
FIG. 1 is a cross sectional side elevation of a basic oxygen furnace showing the devices for introducing gas positioned around the tap hole with gas being introduced through some of the devices during the initial tapping of molten metal.

By referring to FIG. 1 of the drawings, a partial cross section of a metallurgical vessel such as a basic oxygen furnace having a metal shell 10 and a refractory lining 11 will be seen to be provided with a tap hole 12. The metallurgical vessel is provided with means for tilting it (not shown) so that it can be moved from its normal upright position to tilted positions wherein the metal M will flow out of th tap hole 12.

In FIG. 1 of the drawings, the vessel has been tilted so that the metal M is beginning to flow through the tap hole 12 in a desired stream. A plurality of refractory bodies 13 are positioned in the refractory lining 11 and the refractory bodies 13 are so formed as to define a plurality of passageways 14 therebetween, the passageways 14 being arranged in a desirable pattern surrounding the tap hole 12. Gas supply pipes 15, 16 and 17 respectively communicate by way of control valves 18, 19 and 20 respectively with one or more of the passageways 14 between the refractory bodies 14 and with a suitable source of a desirable gas such as nitrogen or argon.

Still referring to FIG. 1 of the drawings, it will be seen that a layer of slag S on the molten metal M is positioned in spaced relation to the tap hole 12 by an upward current of molten metal M created by the introduction of gas through the supply pipes 16 and 17 and the control valves 19 and 20 respectively, and in that area of the metallurgical vessel on the lower side of the tap hole 12. The upwardly bubbling and moving current of molten metal is illustrated rising above the level of the remaining molten metal so that the slag S is moved away from the area of the tap hole 12 with the result that only clean metal, such as steel from a basic oxygen furnace, flows through the tap hole 12.

Figure 2:
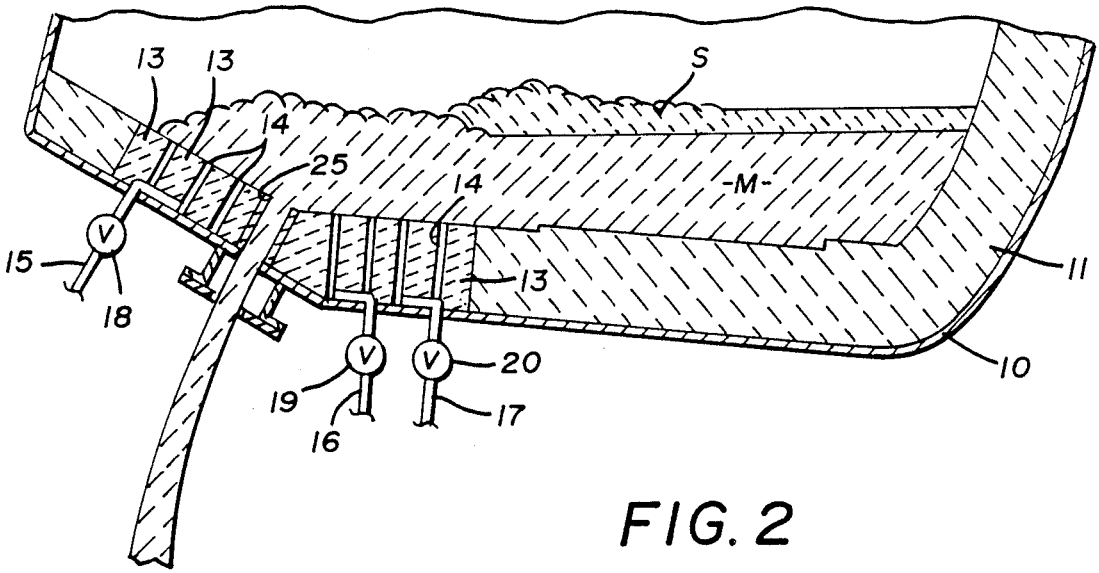
FIG. 2 is a cross sectional side elevation of a basic oxygen furnace showing the devices for introducing gas into the molten metal around the tap hole and in operation with the molten metal in a further stage of tapping.

By referring now to FIG. 2 of the drawings, the metallurgical vessel 10 of FIG. 1 may be seen in a further tilted position where the molten metal M now completely covers the area surrounding the tap hole and wherein gas is now flowing through the passageways 14 between the refractory bodies 13 in a pattern completely surrounding the tap hole 12 and moving the molten metal upwardly in a swirling bubbling rising column of molten metal which effectively moves the slag S away from the area of the molten metal above the tap hole 12 with the result that only clean metal flows outwardly of the tap hole 12.

Figure 3:
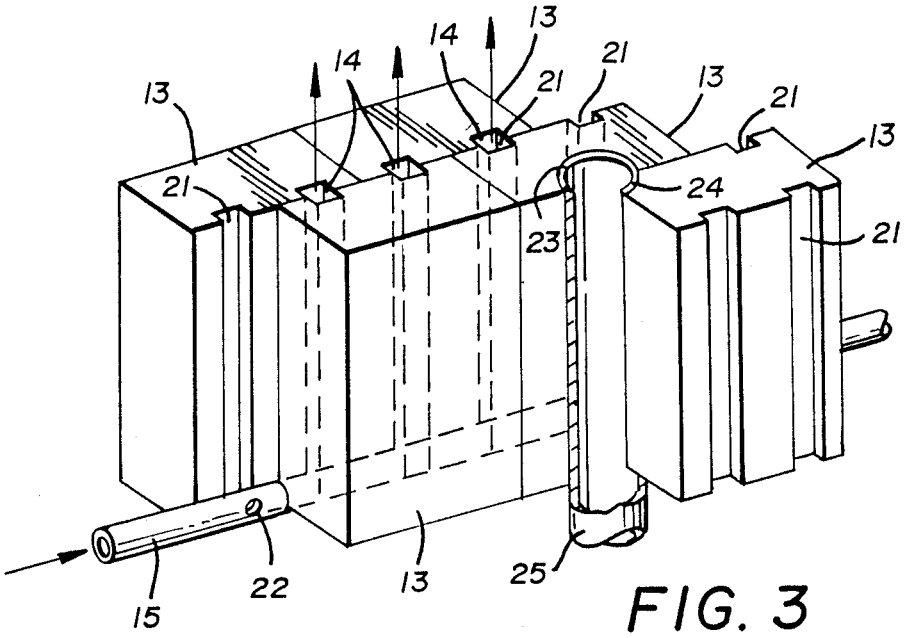
FIG. 3 is an enlarged perspective elevation of several of the refractory devices forming gas passageways as seen in FIGS. 1 and 2.

In FIG. 3 of the drawings, a perspective elevation of several of the rectangular refractory bodies 13 maybe seen as being formed with oppositely disposed channels 21 therein which are in registry with one another to form the passageways 14 through which the gas is directed into the molten metal in the metallurgical vessel as hereinbefore described. The channels 21 are of known widths and depths. The lower corners of the refractory bodies 13 are shaped to accommodate one of the gas pipes 15, 16 and 17 and openings 22 in the pipe 15 illustrated in FIG. 3 communicate with the passageways 14 formed by the channels 21.

Still referring to FIG. 3 of the drawings, it will be seen that three of the refractory bodies 13 have half circular and quarter circular channels 23 and 24 respectively formed therein so as to form a cross sectionally circular opening upwardly through the assembled refractory bodies 13 which in effect becomes an extension of the tap hole 12 of the metallurgical vessel. In FIG. 3 of the drawings, a sleeve 25, preferably metallic, is illustrated as being positioned in this cross sectionally circular opening and by referring to FIGS. 1 and 2 of the drawings it will be been that the sleeve 25 extends downwardly and registers with the tap hole opening in the shell 10 of the metallurgical vessel.

By referring again to FIG. 3 of the drawings, it will observed that the refractory bodies 13 having the half circular and quarter circular channels 23 and 24 respectively therein may be formed of non-permeable refractory or alternately they may be formed of porous refractory and when so modified one or more of the gas supply pipes 15, 16 and 17 respectively, may communicate with the porous refractory so that the gas supplied to the devices will flow upwardly through the porous refractory and create an additional bubbling and stirring and rising column action immediately adjacent the tap hole 12 and the vertical extension thereof formed by a cross sectionally circular opening in which the sleeve 25 is positioned.

Figure 4:
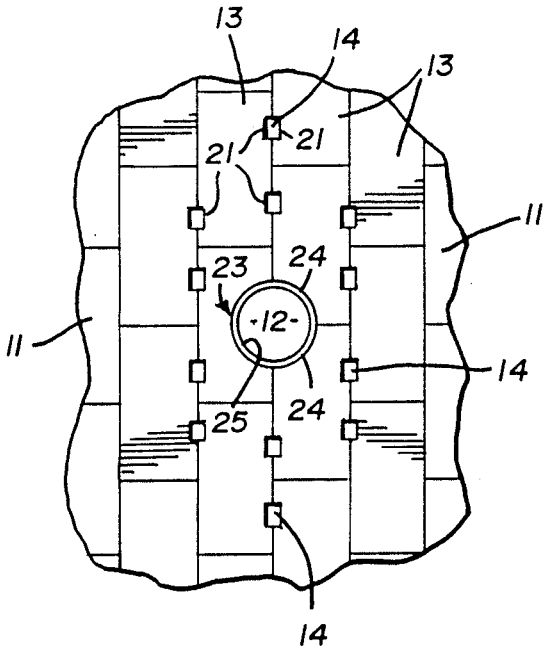
FIG. 4 is a top plan view of several of the refractory devices defining gas passageways around a tap hole in a metallurgical vessel.

By referring now to FIG. 4 of the drawings, a plan view of the series of refractory bodies 13 in assembled position may be seen surrounding the tap hole 12 and the sleeve 25 positioned therein. The passageways 14 are illustrated as rectangular openings defined by the channels 21 in the refractory bodies 13 so as to form desirably shaped relatively flat jet-like passageways capable of introducing gas directed therethrough into molten metal in desirable streams to achieve the upwardly moving rolling swirling currents of molten metal essential to the movement of slag on the molten metal away from the area of the moving molten metal flowing into the tap hole 12. The passageway 14 may be shaped in various configurations including elongated ovals, relatively narrow elongated rectangular slot-like passageways or the like as desired and which configurations enable desirable amounts of gas under predetermined pressure to be introduced into the molten metal to create the desired slag separating motion therein. The passageways may comprise tubes.

It will thus be seen that a relatively simple and efficient combination of a metallurgical vessel having a tap hole therein and devices for introducing gas into the area surrounding the tap hole has been disclosed which acts most efficiently in causing a desired separation of slag on the molten metal and permitting the pouring of clean metal from the vessel and having thus described my invention, what I claim is:

1. An improvement in a metallurgical vessel having a refractory lining and a tap hole, the improvement comprising: a plurality of refractory bodies having planar upper and lower and side surfaces, channels in said side surfaces of some of said refractory bodies positioned for registry with channels in the side surfaces of others of said refractory bodies when said refractory bodies are positioned around said tap hole so as to form a portion of said refractory lining, some of said registering channels defining gas passageways and others of said registering channels defining an opening communicating with said tap hole and means communicating with a source of gas and said channels defining said gas passageways for delivering and controlling the gas delivered to said gas passageways.

2. The improvement set forth in claim 1 and wherein said plurality of refractory bodies are rectangular and wherein said channels in said side surfaces extend between said upper and lower surfaces to form said gas passageways.

3. The improvement set forth in claim 1 and wherein some of said refractory bodies have half circular and quarter circular channels in their side surfaces extending between said upper and lower surfaces so as to form said opening registering with said tap hole and forming a cross sectionally circular extension thereof communicating with the interior of said metallurgical vessel when assembled.

4. The improvement set forth in claim 1 and wherein some of said refractory bodies have half circular and quarter circular channels in their side surfaces extending between said upper and lower surfaces so as to form a cross sectionally circular opening registering with said tap hole when said refractory bodies are assembled and forming an extension of said tap hole communicating with the interior of said metallurgical vessel and wherein a cross sectionally circular sleeve is positioned in said cross sectionally circular opening.

5. The improvement set forth in claim 1 and wherein some of said refractory bodies have configurations in their side surfaces extending between said upper and lower surfaces so as to form an opening registering with said tap hole when said refractory bodies are assembled, said opening forming an extension of said tap hole communicating with the interior of said metallurgical vessel.

6. The improvement set forth in claim 1 and wherein some of said refractory bodies have configurations in their side surfaces extending between said upper and lower surfaces so as to form an opening registering with said tap hole when said refractory bodies are assembles, said opening forming an extension of said tap hole communicating with the interior of said metallurgical vessel and wherein some of said refractory bodies are formed of porous material.

* * * * *